US011586120B2

(12) United States Patent
Noguchi et al.

(10) Patent No.: US 11,586,120 B2
(45) Date of Patent: Feb. 21, 2023

(54) TONER FOR DEVELOPING ELECTROSTATIC CHARGE IMAGE, ELECTROSTATIC CHARGE IMAGE DEVELOPER, METHOD FOR PRODUCING TONER FOR DEVELOPING ELECTROSTATIC CHARGE IMAGE, TONER CARTRIDGE, PROCESS CARTRIDGE, IMAGE FORMING APPARATUS, AND IMAGE FORMING METHOD

(71) Applicant: FUJIFILM BUSINESS INNOVATION CORP., Tokyo (JP)

(72) Inventors: Daisuke Noguchi, Kanagawa (JP); Atsushi Sugawara, Kanagawa (JP); Kazuhiko Nakamura, Kanagawa (JP); Hiroshi Nakazawa, Kanagawa (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 6 days.

(21) Appl. No.: 17/405,402

(22) Filed: Aug. 18, 2021

(65) Prior Publication Data

US 2022/0373907 A1 Nov. 24, 2022

(30) Foreign Application Priority Data

May 21, 2021 (JP) ..... JP2021-086310

(51) Int. Cl.
*G03G 9/087* (2006.01)
*G03G 21/18* (2006.01)
(Continued)

(52) U.S. Cl.
CPC ..... *G03G 9/08755* (2013.01); *G03G 9/0804* (2013.01); *G03G 9/0823* (2013.01);
(Continued)

(58) Field of Classification Search
CPC ..... G03G 9/08755; G03G 9/0804; G03G 9/0823; G03G 9/08782; G03G 9/09; G03G 9/107; G03G 21/1814
See application file for complete search history.

(56) References Cited

U.S. PATENT DOCUMENTS 9,703,219 B1 * 7/2017 Matsubara ..... G03G 9/08797
2005/0208407 A1 * 9/2005 Nagase ..... G03G 9/0825 430/110.4

(Continued)

FOREIGN PATENT DOCUMENTS

JP 2000-003071 A 1/2000
JP 2002-351142 A 12/2002
JP 2003-162098 A 6/2003

*Primary Examiner* — Ryan D Walsh
(74) *Attorney, Agent, or Firm* — Oliff PLC

(57) ABSTRACT

A toner for developing an electrostatic charge image contains toner particles containing at least one binder resin, a release agent, and a coloring agent, and a cross-sectional image of the toner particles meets requirements (1) and (2): requirement (1), an average of ten or more domains, per toner particle, of the release agent have an area of 0.5% or more and 5.0% or less of the area of the toner particle; requirement (2), in a Voronoi tessellation generated from the centroids of the domains of the coloring agent, the mean area of the Voronoi cells is 0.020 $\mu m^2$ or more and 0.060 $\mu m^2$ or less, and the standard deviation of the areas of the Voronoi cells is 0.010 $\mu m^2$ or less.

20 Claims, 2 Drawing Sheets

(51) Int. Cl.

| | |
|---|---|
| ***G03G 9/09*** | (2006.01) |
| ***G03G 9/107*** | (2006.01) |
| ***G03G 9/08*** | (2006.01) |

(52) U.S. Cl.
CPC ..... *G03G 9/08782* (2013.01); *G03G 9/09* (2013.01); *G03G 9/107* (2013.01); *G03G 21/1814* (2013.01)

(56) References Cited

U.S. PATENT DOCUMENTS

| | | | | |
|---|---|---|---|---|
| 2016/0085168 | A1* | 3/2016 | Iwazaki ..... | G03G 9/08711 430/105 |
| 2017/0160661 | A1* | 6/2017 | Suzumura ..... | G03G 9/08711 |
| 2019/0041763 | A1* | 2/2019 | Tsuda ..... | G03G 9/08702 |
| 2021/0286284 | A1* | 9/2021 | Yoshihara ..... | G03G 9/08711 |
| 2022/0299897 | A1* | 9/2022 | Tatekawa ..... | G03G 9/0804 |
| 2022/0308484 | A1* | 9/2022 | Kembo ..... | G03G 9/0819 |

* cited by examiner

TONER FOR DEVELOPING ELECTROSTATIC CHARGE IMAGE, ELECTROSTATIC CHARGE IMAGE DEVELOPER, METHOD FOR PRODUCING TONER FOR DEVELOPING ELECTROSTATIC CHARGE IMAGE, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2021-086310 filed May 21, 2021.

BACKGROUND

(i) Technical Field

The present disclosure relates to a toner for developing an electrostatic charge image, an electrostatic charge image developer, a method for producing a toner for developing an electrostatic charge image, a toner cartridge, a process cartridge, an image forming apparatus, and an image forming method.

(ii) Related Art

Japanese Unexamined Patent Application Publication No. 2003-162098 discloses a toner for developing an electrostatic charge image. The toner contains toner particles that contain a binder resin and a coloring agent. In the toner particles, the average horizontal Feret diameter of particles of the coloring agent is between 10 nm and 500 nm, and the percentage of particles of the coloring agent having a horizontal Feret diameter of 2 nm to 300 nm is 50% by number of more.

Japanese Unexamined Patent Application Publication No. 2002-351142 also discloses a toner for developing an electrostatic charge image. The toner contains toner particles that contain a binder resin and a coloring agent, and the toner particles have a sea-island structure. When a perpendicular bisector is drawn across line segments between the centroids of adjacent islands, the mean area of the Voronoi cells formed is between 20000 and 120000 $nm^2$, and the coefficient of variation of the areas of the Voronoi cells is 25% or less.

Japanese Unexamined Patent Application Publication No. 2000-003071 discloses an image forming method performed using multicolor toners in yellow, magenta, cyan, and black each containing a binder resin, a pigment, and a release agent. In each toner, part of the release agent is present as domains in the resin. The variations between the toners in the percentage of this type of release agent are within 20%.

SUMMARY

Aspects of non-limiting embodiments of the present disclosure relate to a toner for developing an electrostatic charge image. When used to form a wide-gamut image on a recording medium having a rough surface, this toner may reproduce the lightness and chroma of colors well compared with a toner for which when a cross-sectional image of its particles is converted into a Voronoi tessellation generated from the centroids of domains of the coloring agent in the toner, the mean area of the Voronoi cells is more than 0.060 $\mu m^2$, and the standard deviation of the areas of the Voronoi cells is more than 0.010 $\mu m^2$.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a toner for developing an electrostatic charge image, the toner containing toner particles containing at least one binder resin, a release agent, and a coloring agent, a cross-sectional image of the toner particles meeting requirements (1) and (2): requirement (1), an average of ten or more domains, per toner particle, of the release agent have an area of 0.5% or more and 5.0% or less of an area of the toner particle; requirement (2), in a Voronoi tessellation generated from centroids of domains of the coloring agent, a mean area of Voronoi cells is 0.020 $\mu m^2$ or more and 0.060 $\mu m^2$ or less, and a standard deviation of areas of the Voronoi cells is 0.010 $\mu m^2$ or less.

BRIEF DESCRIPTION OF THE DRAWINGS

Exemplary embodiments of the present disclosure will be described in detail based on the following figures, wherein.

DETAILED DESCRIPTION

Figure 1:
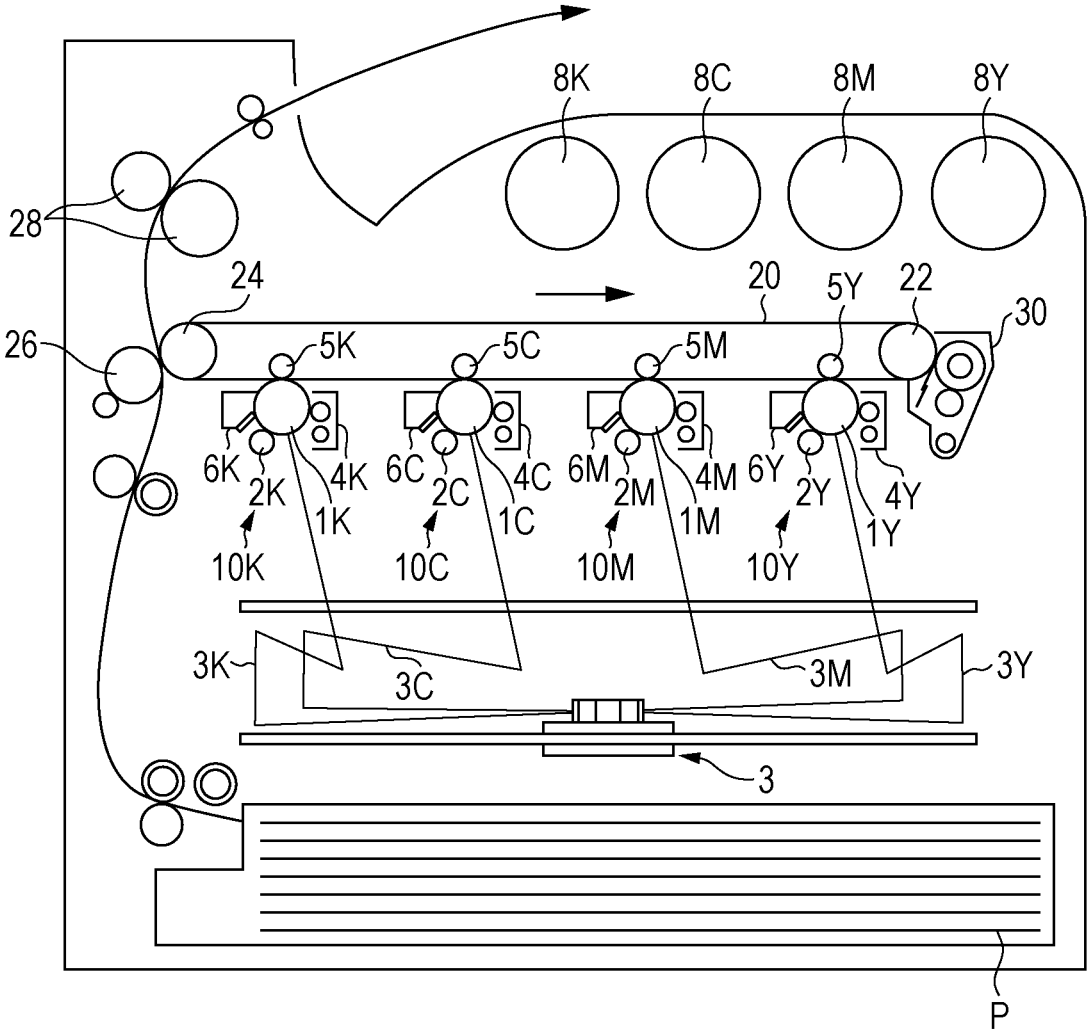
FIG. 1 is a schematic view of the structure of an example of an image forming apparatus according to an exemplary embodiment.

The following describes exemplary embodiments of the present disclosure. The following description and Examples are merely examples of the exemplary embodiments and do not limit the scope of the exemplary embodiments.

Numerical ranges specified with "A-B," "between A and B," "(from) A to B," etc., herein represent inclusive ranges, which include the minimum A and the maximum B as well as all values in between.

The following description also includes series of numerical ranges. In such a series, the upper or lower limit of a numerical range may be substituted with that of another in the same series. The upper or lower limit of a numerical range, furthermore, may be substituted with a value indicated in the Examples section.

A gerund or action noun used in relation to a certain process or method herein does not always represent an independent action. As long as its purpose is fulfilled, the action represented by the gerund or action noun may be continuous with or part of another.

An ingredient herein may be a combination of multiple substances. If a composition described herein contains a combination of multiple substances as one of its ingredients, the amount of the ingredient represents the total amount of the substances in the composition unless stated otherwise.

An ingredient herein, furthermore, may be a combination of multiple kinds of particles. If a composition described herein contains a combination of multiple kinds of particles as one of its ingredients, the diameter of particles of the ingredient is that of the mixture of the multiple kinds of particles present in the composition.

As used herein, the term "(meth)acrylic" refers to at least one of acrylic or methacrylic, and "(meth)acrylate" refers to at least one of an acrylate or a methacrylate.

As used herein, the term "toner" refers to toner for developing an electrostatic charge image, "developer" refers to an electrostatic charge image developer, and "carrier" refers to a carrier for developing an electrostatic charge image.

In the present disclosure, the process of producing toner particles by causing particles of the materials to aggregate and coalesce in a solvent is referred to as emulsion aggregation (EA).

Toner for Developing an Electrostatic Charge Image

Toner according to an exemplary embodiment contains toner particles, and the toner particles contain at least one binder resin, at least one release agent, and at least one coloring agent. A cross-sectional image of the toner particles meets requirements (1) and (2).

Requirement (1): An average of ten or more domains, per toner particle, of the release agent have an area of 0.5% or more and 5.0% or less of the area of the toner particle.

Requirement (2): In a Voronoi tessellation generated from the centroids of the domains of the coloring agent, the mean area of the Voronoi cells is 0.020 $\mu m^2$ or more and 0.060 $\mu m^2$ or less, and the standard deviation of the areas of the Voronoi cells is 0.010 $\mu m^2$ or less.

Meeting requirement (1) means that the release agent has formed an island phase (or a dispersed phase) inside the toner particles and is in a shape in which it certainly works as a release agent.

Meeting requirement (2) means that the coloring agent is dispersed evenly inside the toner particles.

In general, toner particles contain a release agent so that fixed toner will come off the surface of the fixing unit better or that the toner will be fixed at low temperatures better. Toner particles produced by EA usually have a divided inside composed of a sea phase (or continuous phase) of the predominant binder resin, a sea phase of other binder resins, and an island phase of a release agent, and the coloring agent is not inside the island phase but dispersed in the sea phases. Confined to the sea phases in terms of where to go, the coloring agent does not disperse well inside the toner particles. A toner containing such toner particles can fail to reproduce the lightness and chroma of colors well when used to form a wide-gamut image on a recording medium having a rough surface, especially under hot and humid conditions (e.g., a temperature of 32° C. and a relative humidity of 90%).

The toner according to this exemplary embodiment may reproduce the lightness and chroma of colors well when used to form a wide-gamut image on a recording medium having a rough surface. Although it contains release agent(s) in compliance with requirement (1) so that the agent(s) will certainly work as release agent(s) (e.g., help fixed toner come off the fixing unit or help fix the toner at low temperatures), it also meets requirement (2), which is for ensuring even dispersion of the coloring agent inside the toner particles.

The toner according to this exemplary embodiment may further meet requirement (1-1), preferably requirement (1-2).

Requirement (1-1): An average of twelve or more domains, per toner particle, of the release agent have an area of 0.5% or more and 5.0% or less of the area of the toner particle.

Requirement (1-2): An average of fifteen or more domains, per toner particle, of the release agent have an area of 0.5% or more and 5.0% or less of the area of the toner particle.

In requirements (1), (1-1), and (1-2), there is no upper limit to the average number of domains, per toner particle, of the release having an area of 0.5% or more and 5.0% or less of the area of the toner particle. For example, the average number of such domains is 30 or less.

Requirements (1), (1-1), and (1-2) can be fulfilled by producing the toner particles by EA using an appropriate amount of liquid dispersion of particles of the release agent with an appropriate concentration of particles and an appropriate surfactant content.

The toner according to this exemplary embodiment may meet requirement (2-1), preferably requirement (2-2).

Requirement (2-1): In the Voronoi tessellation generated from the centroids of the domains of the coloring agent, the mean area of the Voronoi cells is 0.020 $\mu m^2$ or more and 0.050 $\mu m^2$ or less, and the standard deviation of the areas of the Voronoi cells is 0.008 $\mu m^2$ or less.

Requirement (2-2): In the Voronoi tessellation generated from the centroids of the domains of the coloring agent, the mean area of the Voronoi cells is 0.020 $\mu m^2$ or more and 0.040 $\mu m^2$ or less, and the standard deviation of the areas of the Voronoi cells is 0.006 $\mu m^2$ or less.

Requirements (2), (2-1), and (2-2) can be fulfilled by producing the toner particles by EA with liquid dispersions of particles of binder resins with appropriate volume-average diameters of particles. This is described in detail later herein.

In view of better reproduction of the lightness and chroma of colors when used to form a wide-gamut image on a recording medium having a rough surface, the toner according to this exemplary embodiment may meet requirement (3), preferably requirement (3-1), more preferably requirement (3-2).

Requirement (3): Of all domains of the coloring agent present in the toner particles, 0% by number or more and less than 5% by number are present in the region from the surface to a depth of 100 nm of the toner particle.

Requirement (3-1): Of all domains of the coloring agent present in the toner particles, 0% by number or more and less than 4% by number are present in the region from the surface to a depth of 100 nm of the toner particle.

Requirement (3-2): Of all domains of the coloring agent present in the toner particles, 0% by number or more and less than 3% by number are present in the region from the surface to a depth of 100 nm of the toner particle.

Requirements (3), (3-1), and (3-2) can be fulfilled by producing the toner particles by EA in such a manner that a shell layer will be formed thereon.

The compliance with each requirement can be checked as follows.

The toner particles (with or without adhering external additive(s) thereon) are embedded in a liquid epoxy resin of bisphenol A type with a curing agent, and the resin is cured to give a sample for cutting. The sample for cutting is cut using a microtome equipped with a diamond knife (e.g., LEICA Ultramicrotome, Hitachi High-Technologies) at −100° C. to give a sample for observation.

The sample for observation is observed under a scanning transmission electron microscope (STEM), and the STEM image is recorded at a magnification at which a cross-section of one toner particle is in the field of view. The recorded STEM image is analyzed using image analysis software (e.g., WinROOF 2015, Mitani Corporation) at a 0.010

μm/pixel scale. The shape of the cross-section of the toner particle is determined based on the difference in brightness (contrast) between the embedding epoxy resin and the binder resin in the toner particle.

The STEM image includes cross-sections of toner particles varying in size. Cross-sections whose major axis is 80% or more of the volume-average diameter of the toner particles are eligible, and 300 cross-sections are randomly selected from the eligible ones and observed.

Cross-sections whose major axis is shorter than 80% of the volume-average diameter of the toner particles are probably near an end of the toner particles, and near-end cross-sections do not well reflect the condition of domains in the toner particles. For this reason, cross-sections whose major axis is 80% or more of the volume-average diameter of the toner particles are eligible.

As mentioned herein, the major axis of a cross-section refers to the length of the longest one of all line segments between any two points on the outline of the cross-section.

Requirement (1)

In the cross-section of a toner particle, the number of domains of the release agent having an area of 0.5% or more and 5.0% or less of the area of the toner particle is counted. This is repeated for the cross-sections of 300 toner particles, and the average count, per toner particle, is calculated.

Requirement (2)

In the cross-section of a toner particle, a Voronoi tessellation (a partition into regions closest to a given set of "seeds" by drawing a perpendicular bisector across line segments between adjacent seeds) is generated from the centroids of all domains of the coloring agent, and the area of all resulting Voronoi cells is measured.

The centroid of a domain of the coloring agent is represented by x- and y-coordinates. The centroid's x- and y-coordinates are (a total of $x_i$)/n and (a total of $y_i$)/n, respectively, where n is the number of pixels in the domain and $x_i$ and $y_i$ are the x- and y-coordinates, respectively, of each pixel (i=1, 2, . . . , n).

If the field of view includes any toner particle that is not of interest or if there is an interfering black image region near a toner particle of interest, the image analysis is configured to remove any region that is not a toner particle of interest beforehand.

This is repeated for 300 toner particles, and the mean area of Voronoi cells and the standard deviation of the areas of Voronoi cells are calculated.

Requirement (3)

In the cross-section of a toner particle, the number of all domains of the coloring agent present and that of the domains of the coloring agent whose centroid is not deeper than 100 nm from the surface of the toner particle are counted. This is repeated for the cross-sections of 300 toner particles, and the percentage by number of those domains of the coloring agent whose centroid is not deeper than 100 nm from the surface of the toner particle to all domains of the coloring agent is calculated.

The following describes the details of the toner according to this exemplary embodiment.

The toner according to this exemplary embodiment contains toner particles, optionally with external additives.

Toner Particles

The toner particles contain, for example, at least one binder resin, optionally with at least one coloring agent, at least one release agent, and/or other additives.

Binder Resin

Examples of binder resins include vinyl resins that are homopolymers of monomers such as styrenes (e.g., styrene, para-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene) or copolymers of two or more such monomers.

Non-vinyl resins, such as epoxy resins, polyester resins, polyurethane resins, polyamide resins, cellulose resins, polyether resins, and modified rosin, mixtures of any such resin and vinyl resin(s), and graft copolymers obtained by polymerizing a vinyl monomer in the presence of any such non-vinyl resin may also be used.

One such binder resin may be used alone, or two or more may be used in combination.

Polyester resins are examples of binder resins.

An example of a polyester resin is a known amorphous polyester resin. A combination of an amorphous and a crystalline polyester resin may also be used. In that case, the percentage of the crystalline polyester resin may be 2% by mass or more and 40% by mass or less (preferably 2% by mass or more and 20% by mass or less) of all binder resins.

If a resin is "crystalline" herein, it means that the endothermic profile of the resin as measured by differential scanning calorimetry (DSC) is not stepwise but has a clear peak, specifically a peak with a half width of 10° C. or narrower in DSC performed at a temperature elevation rate of 10° C./min.

The DSC endothermic profile of an "amorphous" resin, by contrast, is stepwise or has no clear peak, or has a peak with a half width boarder than 10° C. under the same conditions.

Amorphous Polyester Resin

An example of an amorphous polyester resin is a polycondensate of a polycarboxylic acid and a polyhydric alcohol. Either commercially available or synthesized amorphous polyester resins may be used.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides and lower-alkyl (e.g., C1-5 alkyl) esters thereof. Of these, aromatic dicarboxylic acids, for example, are preferred.

A combination of a dicarboxylic acid and a crosslinked or branched carboxylic acid having three or more carboxylic groups may also be used. Examples of carboxylic acids having three or more carboxylic groups include trimellitic acid, pyromellitic acid, and anhydrides and lower-alkyl (e.g., C1-5 alkyl) esters thereof.

One polycarboxylic acid may be used alone, or two or more may be used in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Of these, aromatic diols and alicyclic diols, for example, are preferred, and aromatic diols are more preferred.

A combination of a diol and a crosslinked or branched polyhydric alcohol having three or more hydroxyl groups may also be used. Examples of polyhydric alcohols having three or more hydroxyl groups include glycerol, trimethylolpropane, and pentaerythritol.

One polyhydric alcohol may be used alone, or two or more may be used in combination.

The glass transition temperature (Tg) of the amorphous polyester resin may be 50° C. or more and 80° C. or less, preferably 50° C. or more and 65° C. or less.

This glass transition temperature is that determined from the DSC curve of the resin, which is measured by differential scanning calorimetry (DSC). More specifically, this glass transition temperature is the "extrapolated initial temperature of glass transition" as in the methods for determining glass transition temperatures set forth in JIS K7121-1987 "Testing Methods for Transition Temperatures of Plastics."

The weight-average molecular weight (Mw) of the amorphous polyester resin may be 5000 or more and 1000000 or less, preferably 7000 or more and 500000 or less.

The number-average molecular weight (Mn) of the amorphous polyester resin may be 2000 or more and 100000 or less.

The molecular weight distribution, Mw/Mn, of the amorphous polyester resin may be 1.5 or more and 100 or less, preferably 2 or more and 60 or less.

These weight- and number-average molecular weights are those measured by gel permeation chromatography (GPC). The analyzer is Tosoh's HLC-8120 GPC chromatograph with Tosoh's TSKgel SuperHM-M column (15 cm), and the eluate is tetrahydrofuran (THF). Comparing the measured data with a molecular-weight calibration curve prepared using monodisperse polystyrene standards will give the weight- and number-average molecular weights.

As for production, the amorphous polyester resin can be produced by known methods. A specific example is to polymerize the raw materials at a temperature of 180° C. or more and 230° C. or less. The pressure in the reaction system may optionally be reduced to remove the water and alcohol that are produced as condensation proceeds.

If the raw-material monomers do not dissolve or are not miscible together at the reaction temperature, a high-boiling solvent may be added as a solubilizer to make the monomers dissolve. In that case, the solubilizer is removed by distillation during the polycondensation. Any monomer not miscible with the other(s) may be condensed with the planned counterpart acid(s) or alcohol(s) before the polycondensation process.

Crystalline Polyester Resin

An example of a crystalline polyester resin is a polycondensate of a polycarboxylic acid and a polyhydric alcohol. Either commercially available or synthesized crystalline polyester resins may be used.

Crystalline polyester resins made with linear aliphatic polymerizable monomers have greater potential to form a crystal structure than those made with aromatic polymerizable monomers.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), and anhydrides and lower-alkyl (e.g., C1-5 alkyl) esters thereof.

A combination of a dicarboxylic acid and a crosslinked or branched carboxylic acid having three or more carboxylic groups may also be used. Examples of carboxylic acids having three or more carboxylic groups include aromatic carboxylic acids (e.g., 1,2,3-benzenetricarboxylic acid, 1,2,4-benzenetricarboxylic acid, and 1,2,4-naphthalenetricarboxylic acid) and anhydrides and lower-alkyl (e.g., C1-5 alkyl) esters thereof.

A combination of a dicarboxylic acid such as listed above and a dicarboxylic acid having a sulfonic acid group or an ethylenic double bond may also be used.

One polycarboxylic acid may be used alone, or two or more may be used in combination.

Examples of polyhydric alcohols include aliphatic diols (e.g., C7-20 linear aliphatic diols). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these, 1,8-octanediol, 1,9-nonanediol, and 1,10-decanediol are preferred.

A combination of a diol and a crosslinked or branched alcohol having three or more hydroxyl groups may also be used. Examples of alcohols having three or more hydroxyl groups include glycerol, trimethylolethane, trimethylolpropane, and pentaerythritol.

One polyhydric alcohol may be used alone, or two or more may be used in combination.

In the polyhydric alcohol(s), the percentage of aliphatic diols may be 80 mol % or more, preferably 90 mol % or more.

The melting temperature of the crystalline polyester resin may be 50° C. or more and 100° C. or less, preferably 55° C. or more and 90° C. or less, more preferably 60° C. or more and 85° C. or less.

This melting temperature is the "peak melting temperature" of the resin as in the methods for determining melting temperatures set forth in JIS K7121-1987 "Testing Methods for Transition Temperatures of Plastics" and is determined from the DSC curve of the resin, which is measured by differential scanning calorimetry (DSC).

The weight-average molecular weight (Mw) of the crystalline polyester resin may be 6,000 or more and 35,000 or less.

The crystalline polyester resin can be produced by known methods. For example, the crystalline polyester resin may be produced in the same way as the amorphous polyester resin.

The binder resin content may be 40% by mass or more and 95% by mass or less of the toner particles as a whole. Preferably, the binder resin content is 50% by mass or more and 90% by mass or less, more preferably 60% by mass or more and 85% by mass or less.

Coloring Agent

Examples of coloring agents include pigments, such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, Calco oil blue, methylene blue chloride, phthalocyanine blue, pigment blue, phthalocyanine green, and malachite green oxalate; and dyes, such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, and thiazole dyes.

One coloring agent may be used alone, or two or more may be used in combination.

Surface-treated coloring agents may optionally be used. A combination of a coloring agent and a dispersant may also be used. It is also possible to use multiple coloring agents in combination.

The coloring agent content may be 1% by mass or more and 30% by mass or less of the toner particles as a whole. Preferably, the coloring agent content is 3% by mass or more and 15% by mass or less.

Release Agent

Examples of release agents include hydrocarbon waxes; natural waxes, such as carnauba wax, rice wax, and candelilla wax; synthesized or mineral/petroleum waxes, such as montan wax; and ester waxes, such as fatty acid esters and montanates. Other release agents may also be used.

The melting temperature of the release agent is the "peak melting temperature" of the agent as in the methods for determining melting temperatures set forth in JIS K7121-1987 "Testing Methods for Transition Temperatures of Plastics" and is determined from the DSC curve of the agent, which is measured by differential scanning calorimetry (DSC).

The release agent content may be 1% by mass or more and 20% by mass or less of the toner particles as a whole. Preferably, the release agent content is 5% by mass or more and 15% by mass or less.

Other Additives

Examples of other additives include known additives, such as magnetic substances, charge control agents, and inorganic powders. Such additives, if used, are contained in the toner particles as internal additives.

Characteristics and Other Details of the Toner Particles

The toner particles may be single-layer toner particles or may be "core-shell" toner particles, i.e., toner particles formed by a core (core particle) and a coating that covers the core (shell layer).

A possible structure of core-shell toner particles is one in which the core contains the binder resin together with the coloring agent, release agent, and/or other additives if used, and the coating contains the binder resin.

The volume-average diameter of the toner particles (D50v) may be 2 μm or more and 10 μm or less, preferably 4 μm or more and 8 μm or less.

The average diameters and geometric standard deviations of toner particles indicated herein are those measured using Coulter Multisizer II (Beckman Coulter) and ISOTON-II electrolyte (Beckman Coulter).

For measurement, a sample of the toner particles, 0.5 mg or more and 50 mg or less, is added to 2 ml of a 5% by mass aqueous solution of a surfactant as a dispersant (e.g., a sodium alkylbenzene sulfonate). The resulting dispersion is added to 100 ml or more and 150 ml or less of the electrolyte.

The electrolyte with the suspended sample therein is sonicated for 1 minute using a sonicator, and the size distribution is measured on 50000 sampled particles within a diameter range of 2 μm to 60 μm using Coulter Multisizer II with an aperture size of 100 μm.

The measured distribution is divided into segments by particle size (channels), and the cumulative distribution of volume and that of frequency are plotted starting from the smallest diameter. The particle diameter at which the cumulative volume is 16% and that at which the cumulative frequency is 16% are defined as volume diameter D16v and number diameter D16p, respectively, of the toner particles. The particle diameter at which the cumulative volume is 50% and that at which the cumulative frequency is 50% are defined as the volume-average diameter D50v and cumulative number-average diameter D50p, respectively, of the toner particles. The particle diameter at which the cumulative volume is 84% and that at which the cumulative frequency is 84% are defined as volume diameter D84v and number diameter D84p, respectively, of the toner particles.

These are used to calculate the geometric standard deviation by volume (GSDv) and geometric standard deviation by number (GSDp). GSDv is given by $(D84v/D16v)^{1/2}$, and GSDp is given by $(D84p/D16p)^{1/2}$.

The average roundness of the toner particles may be 0.94 or more and 1.00 or less, preferably 0.95 or more and 0.98 or less.

The average roundness of the toner particles is given by (circumference of the equivalent circle)/(circumference) [(circumference of circles having the same projected area as particle images)/(circumference of projected images of the particles)]. Specifically, the average roundness of the toner particles can be measured as follows.

First, a portion of the toner particles of interest is collected by aspiration in such a manner that it will form a flat stream. This flat stream is photographed with a flash to capture the figures of the particles in a still image. The images of 3500 sampled particles are analyzed using a flow particle-image analyzer (Sysmex FPIA-3000), and the average roundness is determined from the results.

If the toner contains external additives, the external additives are removed beforehand by dispersing the toner (developer) of interest in water containing a surfactant and then sonicating the resulting dispersion.

External Additives

An example of an external additive is inorganic particles. Examples of inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaOSiO_2$, $K_2O(TiO_2)_n$, $Al_2O_3.2SiO_2$, $CaCO_3$, $MgCO_3$, $BaSO_4$, and $MgSO_4$.

The inorganic particles as an external additive may have a hydrophobic surface, for example created by immersion in a hydrophobizing agent. The hydrophobizing agent can be of any kind, but examples include silane coupling agents, silicone oil, titanate coupling agents, and aluminum coupling agents. One such agent may be used alone, or two or more may be used in combination.

The amount of hydrophobizing agent is usually, for example, 1 part by mass or more and 10 parts by mass or less per 100 parts by mass of the inorganic particles.

Materials like resin particles (particles of polystyrene, polymethyl methacrylate, melamine resins, etc.) and active cleaning agents (e.g., metal salts of higher fatty acids, typically zinc stearate, and particles of fluoropolymers) are also examples of external additives.

The percentage of the external additives may be 0.01% by mass or more and 5% by mass or less, preferably 0.01% by mass or less and 2.0% by mass or less, of the toner particles.

Method for Producing a Toner for Developing an Electrostatic Charge Image

A method according to an exemplary embodiment for producing toner is one that includes EA production of toner particles. The method includes the following.

Mixing liquid dispersions of binder-resin particles, each of which contains particles of a binder resin, a liquid dispersion of release-agent particles, which contains particles of a release agent, and a liquid dispersion of coloring-agent particles, which contains particles of a coloring agent, together to give a liquid dispersion mixture containing the particles of binder resins, the particles of a release agent, and the particles of coloring agent (mixing);

forming aggregates by causing the particles of binder resins, the particles of a release agent, and the particles of a coloring agent to aggregate in the liquid dispersion mixture (aggregation); and forming toner particles by heating the liquid dispersion containing the aggregates and thereby making the aggregates fuse and coalesce (coalescence).

In the method according to this exemplary embodiment for producing toner, the liquid dispersions of binder-resin particles include at least two liquid dispersions of amorphous polyester resin particles, each of which contains particles of an amorphous polyester resin; and the difference between D1 and D2 is 30 nm or more and 150 nm or less, where D1 is the volume-average diameter of the particles of an amorphous polyester resin in the liquid dispersion in which the particles of an amorphous polyester resin have a greater diameter than the other of, or the greatest diameter among all of, the at least two (also referred to as "liquid dispersion of amorphous polyester resin particles A"), and D2 is the volume-average diameter of the particles of an amorphous polyester resin in the liquid dispersion in which the particles of an amorphous polyester resin have a smaller diameter than the other of, or the smallest diameter among all of, the at least two (also referred to as "liquid dispersion of amorphous polyester resin particles B").

The particles of amorphous polyester resins are particles of binder resins that will form sea phases in the toner particles. By virtue of the use of two liquid dispersions of amorphous polyester resin particles with different average diameters, the particles of a coloring agent may be prevented from aggregate homogeneously inside the aggregates. This may, the inventors presume, help ensure uniform dispersion of the coloring agent in the finished toner particles.

If the difference between volume-average diameters of particles D1 and D2 were less than 30 nm, the two-liquid strategy would not be so effective in preventing the homogeneous aggregation of the particles of a coloring agent inside the aggregates.

If the difference between volume-average diameters of particles D1 and D2 were more than 150 nm, the particles of a coloring agent would aggregate homogeneously because the particles of an amorphous polyester resin having volume-average diameter D2 would be packed in the gaps between those having volume-average diameter D1.

For these reasons, the difference between volume-average diameters of particles D1 and D2 is 30 nm or more and 150 nm or less. It may be 40 nm or more and 120 nm or less, and preferably is 50 nm or more and 100 nm or less.

The volume-average diameter of the particles of an amorphous polyester resin in liquid dispersion of amorphous polyester resin particles A, or volume-average diameter of particles D1, may be 130 nm or more and 250 nm. Preferably, volume-average diameter of particles D1 is 140 nm or more and 200 nm or less, more preferably 150 nm or more and 180 nm or less.

The volume-average diameter of the particles of an amorphous polyester resin in liquid dispersion of amorphous polyester resin particles B, or volume-average diameter of particles D2, may be 50 nm or more and 100 nm. Preferably, volume-average diameter of particles D2 is 55 nm or more and 95 nm or less, more preferably 60 nm or more and 90 nm or less.

The volume-average diameter of the particles of an amorphous polyester resin in each liquid dispersion of amorphous polyester resin particles is that determined by measuring the size distribution of the particles using a laser-diffraction particle size distribution analyzer (e.g., HORIBA LA-700). The particle diameter at which the cumulative volume from the smallest diameter is 50% is the volume-average diameter of the particles.

The following describes the method according to this exemplary embodiment for producing toner and materials used therein in detail.

Mixing

Liquid dispersions of binder-resin particles, a liquid dispersion of release-agent particles, and a liquid dispersion of coloring-agent particles are mixed together. The order of mixing of these liquid dispersions of particles is not critical.

This will give a liquid dispersion mixture containing the particles of binder resins, the particles of a release agent, and the particles of coloring agent.

In the following, what applies to all of the liquid dispersions of binder-resin particles, release-agent particles, and coloring-agent particles is described collectively by referring to them as "the liquid dispersions of particles."

An exemplary embodiment of the liquid dispersions of particles is liquid dispersions obtained by dispersing the materials in particulate form in a dispersion medium using a surfactant.

The dispersion medium for the liquid dispersions of particles may be an aqueous medium. Examples of aqueous dispersion media include water and alcohols. If water is used, its ionic content may be reduced in advance, for example by distillation or deionization. One such aqueous medium may be used alone, or two or more may be used in combination.

For the surfactant used to disperse the materials in the dispersion medium, examples include anionic surfactants, such as sulfates, sulfonates, phosphates, and soap surfactants; cationic surfactants, such as amine salts and quaternary ammonium salts; and nonionic surfactants, such as polyethylene glycol surfactants, ethylene oxide adducts of alkylphenols, and polyhydric alcohols. One surfactant may be used alone, or two or more may be used in combination. A combination of a nonionic surfactant with an anionic or cationic surfactant may also be used.

The dispersion of the materials in particulate form in the dispersion medium can be carried out by known dispersion techniques, such as the use of a rotary-shear homogenizer or a ball mill, sand mill, Dyno-Mill, or other medium mill.

As for the resins, one possible method for dispersing them in their dispersion media in particulate form is phase inversion emulsification. In phase inversion emulsification, the resin is first dissolved in a hydrophobic organic solvent in which the resin is soluble. The resulting organic continuous phase (0 phase) is neutralized with a base, and then an aqueous medium (W phase) is added. The resulting conversion of the resin emulsion from the W/O to O/W form will make the resin dispersed in the aqueous medium in particulate form.

The volume-average diameter of the particles of an amorphous polyester resin in each liquid dispersion of amorphous polyester resin particles can be controlled by adjusting one or both of the amount of hydrophobic organic solvent and that of base used to produce the liquid dispersion of particles by phase inversion emulsification. The volume-average diameter of the particles of a polyester resin decreases with increasing amount(s) of hydrophobic organic solvent and/or base used.

As for the liquid dispersions of particles other than those of amorphous polyester resin particles, the volume-average diameter of the dispersed particles may be 30 nm or more and 300 nm or less. Preferably, the volume-average diameter of the dispersed particles is 50 nm or more and 250 nm or less, more preferably 80 nm or more and 200 nm or less.

The volume-average diameter of the dispersed particles in each liquid dispersion of particles is that determined by measuring the size distribution of the particles using a laser-diffraction particle size distribution analyzer (e.g., HORIBA LA-700). The particle diameter at which the cumulative volume from the smallest diameter is 50% is the volume-average diameter of the particles.

The percentage of the dispersed particles in each liquid dispersion of particles may be 5% by mass or more and 50% by mass or less. Preferably, the percentage of the dispersed particles is 10% by mass or more and 40% by mass or less, more preferably 15% by mass or more and 30% by mass or less.

For certain kinds of binder resins, the liquid dispersions of binder-resin particles may contain a surfactant for more stable dispersion of the particles of a binder resin.

If a liquid dispersion of binder-resin particles contains a surfactant, the surfactant content may be 1% by mass or more and 10% by mass or less of the particles of a binder resin. Preferably, the surfactant content is 1% by mass or more and 8% by mass or less, more preferably 1% by mass or more and 5% by mass or less.

The liquid dispersion of release-agent particles may contain a surfactant for more stable dispersion of the particles of a release agent. The surfactant may also help ensure requirement (1) is met by encouraging heterogeneous aggregation with the particles of binder resins.

The surfactant content of the liquid dispersion of release-agent particles may be 1% by mass or more and 5% by mass or less of the particles of a release agent.

Preferably, the surfactant content is 1% by mass or more and 4% by mass or less, more preferably 1% by mass or more and 3% by mass or less.

In the liquid dispersion mixture, the sets of particles may be present in any of the following ratios by mass.

The ratio between the particles of binder resins and the particles of a release agent may be between 100:4 and 100:24 (binder resins:release agent). Preferably, this ratio is between 100:8 and 100:22, more preferably between 100:12 and 100:20.

The ratio between the particles of binder resins and the particles of a coloring agent may be between 100:4 and 100:24 (binder resins:coloring agent). Preferably, this ratio is between 100:8 and 100:22, more preferably between 100:12 and 100:20.

The pH of the liquid dispersion mixture may be adjusted to 4.5 or more and 6.0 or less. Adjusting the pH of the liquid dispersion mixture to 4.5 or more and 6.0 or less before the formation of aggregates may help ensure all material particles will aggregate when each liquid dispersion of particles has a zeta potential in the range specified above.

The pH of the liquid dispersion mixture can be adjusted by, for example, adding an acidic aqueous solution of nitric acid, hydrochloric acid, or sulfuric acid.

Aggregation (First Aggregation)

Aggregates are formed by causing the particles of binder resins, the particles of a release agent, and the particles of a coloring agent to aggregate.

If the method according to this exemplary embodiment for producing toner includes the formation of second aggregates (formation of a shell layer) as described below, the formation of aggregates is referred to as "first aggregation." The first aggregation is to form the cores in a core-shell toner.

The formation of aggregates includes, for example:

adding at least one flocculant to the liquid dispersion mixture while stirring the liquid dispersion mixture; and heating the liquid dispersion mixture with the flocculant therein while stirring it to increase its temperature.

Examples of flocculants include surfactants having the opposite polarity with respect to the surfactant(s) in the liquid dispersion mixture, inorganic metal salts, and divalent or higher-valency metal complexes. One flocculant may be used alone, or two or more may be used in combination.

Examples of inorganic metal salts include metal salts such as calcium chloride, calcium nitrate, barium chloride, magnesium chloride, zinc chloride, aluminum chloride, and aluminum sulfate; and polymers of inorganic metal salts, such as polyaluminum chloride, polyaluminum hydroxide, and calcium polysulfide.

Divalent or higher-valency metal salt compounds may be used as flocculants. Trivalent metal salt compounds are preferred, and trivalent inorganic aluminum salt compounds are more preferred. Examples of trivalent inorganic aluminum salt compounds include aluminum chloride, aluminum sulfate, polyaluminum chloride, and polyaluminum hydroxide.

The amount of flocculant added is not critical. If the flocculant is a trivalent metal salt compound, the trivalent metal salt compound may be added in an amount of 0.5 parts by mass or more and 5.0 parts by mass or less per 100 parts by mass of the binder resins. Preferably, the amount of the trivalent metal salt compound is 0.6 parts by mass or more and 4.0 parts by mass or less, more preferably 0.7 parts by mass or more and 3.0 parts by mass or less.

The temperature to which the liquid dispersion mixture is heated is selected based on the glass transition temperature (Tg) of the particles of binder resins. For example, it may be (Tg of the particles of binder resins minus 30° C.) or more and (Tg of the particles of binder resins minus 5° C.) or less.

If the liquid dispersion mixture contains multiple sets of particles of binder resins with different Tgs, the lowest one is the glass transition temperature in this context.

Second Aggregation

If the manufacturer wants to produce a core-shell toner, second aggregates may then be formed to form the shell layer.

The second aggregates are formed by mixing the liquid dispersion containing the aggregates and at least one liquid dispersion containing shell-layer resin particles together and causing the shell-layer resin particles to aggregate on the surface of the aggregates.

The liquid dispersion containing shell-layer resin particles may be one or more of the liquid dispersions of binder-resin particles used to form the cores. Preferably, it is liquid dispersion(s) of particles of a polyester resin, more preferably liquid dispersion(s) of particles of an amorphous polyester resin.

The formation of second aggregates includes, for example:

adding the liquid dispersion of shell-layer resin particles to the liquid dispersion containing the aggregates while stirring the liquid dispersion containing the aggregates; and heating the liquid dispersion containing the aggregates with the liquid dispersion of shell-layer resin particles therein while stirring it.

The temperature to which the liquid dispersion containing the aggregates is heated is selected based on the glass transition temperature (Tg) of the shell-layer resin particles. For example, it may be (Tg of the shell-layer resin particles minus 30° C.) or more and (Tg of the shell-layer resin particles minus 5° C.) or less.

After the aggregates or second aggregates have grown to a predetermined size and before the heating for the formation of toner particles takes place, a chelating agent for the flocculant may be added to the liquid dispersion containing the aggregates or second aggregates to terminate the growth of the aggregates or second aggregates.

Examples of chelating agents include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of chelating agent added may be 0.01 parts by mass or more and 5.0 parts by mass or less per 100 parts by mass of the particles of binder resins. Preferably, the amount of chelating agent is 0.1 parts by mass or more and less than 3.0 parts by mass.

After the aggregates or second aggregates have grown to a predetermined size and before the heating for the formation of toner particles takes place, the pH of the liquid dispersion containing the aggregates or second aggregates may be increased to terminate the growth of the aggregates or second aggregates.

An example of how to increase the pH of the liquid dispersion containing the aggregates or second aggregates is to add at least one selected from the group consisting of aqueous solutions of alkali hydroxides and aqueous solutions of alkaline earth hydroxides.

The target pH of the liquid dispersion containing the aggregates or second aggregates may be 8 or more and 10 or less.

Coalescence

Toner particles are formed by heating the liquid dispersion containing the aggregates and thereby making the aggregates fuse and coalesce.

If second aggregates are formed, the formation of toner particles is by heating the liquid dispersion containing the second aggregates and thereby making the second aggregates fuse and coalesce. This will give core-shell toner particles.

The configuration described below is common to both the aggregates and second aggregates.

The temperature to which the liquid dispersion containing the aggregates is heated may be equal to or higher than the glass transition temperature (Tg) of the binder resins. Specifically, it may be the Tg of the binder resins plus 10° C. to 35° C.

If the aggregates contain multiple binder resins with different Tgs, the highest one is the glass transition temperature in this context.

The toner particles formed in the liquid dispersion are then washed, separated, and dried by known methods to give dry toner particles. The washing may be carried out by sufficient replacement with deionized water in view of chargeability. The separation may be carried out by, for example, suction filtration or pressure filtration in view of productivity. The drying may be carried out by, for example, lyophilization, flash drying, fluidized drying, or vibrating fluidized drying in view of productivity.

Addition of External Additives

The method according to this exemplary embodiment for producing toner may include adding external additives to the toner particles.

Electrostatic Charge Image Developer

An electrostatic charge image developer according to an exemplary embodiment contains at least toner according to the above exemplary embodiment.

The electrostatic charge image developer according to this exemplary embodiment may be a one-component developer, which is substantially toner according to the above exemplary embodiment, or may be a two-component developer, which is a mixture of the toner and a carrier.

The carrier can be of any kind and can be a known one. Examples include a coated carrier, formed by a core magnetic powder and a coating resin on its surface; a magnetic powder-dispersed carrier, formed by a matrix resin and a dispersed magnetic powder contained therein; and a resin-impregnated carrier, which is a porous magnetic powder impregnated with resin.

The particles as a component of a magnetic powder-dispersed or resin-impregnated carrier can serve as a core material. A carrier obtained by coating the surface of them with resin may also be used.

The magnetic powder can be, for example, a powder of a magnetic metal, such as iron, nickel, or cobalt; or a powder of a magnetic oxide, such as ferrite or magnetite.

The coating or matrix resin can be, for example, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylate copolymer, a straight silicone resin (resin having organosiloxane bonds) or its modified form, a fluoropolymer, polyester, polycarbonate, a phenolic resin, or an epoxy resin. Electrically conductive particles or other additives may be contained in the coating or matrix resin. Examples of electrically conductive particles include particles of metal, such as gold, silver, or copper, and particles of carbon black, titanium oxide, zinc oxide, tin oxide, barium sulfate, aluminum borate, and potassium titanate.

The resin coating of the surface of the core material can be achieved by, for example, coating the surface with a coating-layer solution prepared by dissolving the coating resin and additives (optional) in a solvent. The solvent can be of any kind and is selected considering, for example, the kind of resin used and suitability for coating.

Specific examples of how to provide the resin coating include dipping, i.e., immersing the core material in the coating-layer solution; spraying, i.e., applying a mist of the coating-layer solution onto the surface of the core material; fluidized bed coating, i.e., applying a mist of the coating-layer solution to a core material floated on a stream of air; and kneader-coater coating, i.e., mixing the carrier core material and the coating-layer solution in a kneader-coater and then removing the solvent.

For a two-component developer, the mix ratio (by mass) between the toner and the carrier may be between 1:100 (toner:carrier) and 30:100. Preferably, the mix ratio is between 3:100 and 20:100.

Image Forming Apparatus and Image Forming Method

The following describes an image forming apparatus and an image forming method according to exemplary embodiments.

An image forming apparatus according to an exemplary embodiment includes an image carrier; a charging component that charges the surface of the image carrier; an electrostatic charge image creating component that creates an electrostatic charge image on the charged surface of the image carrier; a developing component that contains an electrostatic charge image developer and develops, using the electrostatic charge image developer, the electrostatic charge image on the surface of the image carrier to form a toner image; a transfer component that transfers the toner image on the surface of the image carrier to the surface of a recording medium; and a fixing component that fixes the toner image on the surface of the recording medium. The electrostatic charge image developer is an electrostatic charge developer according to the above exemplary embodiment.

The image forming apparatus according to this exemplary embodiment performs an image forming method (image forming method according to an exemplary embodiment) that includes charging the surface of an image carrier; creating an electrostatic charge image on the charged surface of the image carrier; developing, using an electrostatic charge image developer according to the above exemplary embodiment, the electrostatic charge image on the surface of the image carrier to form a toner image; transferring the toner image on the surface of the image carrier to the surface of a recording medium; and fixing the toner image on the surface of the recording medium.

The configuration of the image forming apparatus according to this exemplary embodiment can be applied to known types of image forming apparatuses. Examples include a direct-transfer image forming apparatus, which forms a toner image on the surface of an image carrier and transfers it directly to a recording medium; an intermediate-transfer image forming apparatus, which forms a toner image on the surface of an image carrier, transfers it to the surface of an intermediate transfer body (first transfer), and then transfers the toner image on the surface of the intermediate transfer body to the surface of a recording medium (second transfer); an image forming apparatus having a cleaning component that cleans the surface of the image carrier between the transfer of the toner image and charging; and an image forming apparatus having a static eliminator that removes static electricity from the surface of the image carrier by irradiating the surface with antistatic light between the transfer of the toner image and charging.

If the image forming apparatus according to this exemplary embodiment is an intermediate-transfer one, the transfer component may include, for example, an intermediate transfer body, a first transfer component, and a second transfer component. The toner image formed on the surface of the image carrier is transferred to the surface of the intermediate transfer body by the first transfer component (first transfer), and then the toner image on the surface of the intermediate transfer body is transferred to the surface of a recording medium by the second transfer component (second transfer).

Part of the image forming apparatus according to this exemplary embodiment, e.g., a portion including the developing component, may have a cartridge structure, i.e., a structure that allows the part to be attached to and detached from the image forming apparatus (or may be a process cartridge). An example of a process cartridge is one that includes a developing component that contains an electrostatic charge image developer according to the above exemplary embodiment.

The following describes an example of an image forming apparatus according to this exemplary embodiment. This is not the only possible form. The following describes some of its structural elements with reference to a drawing.

FIG. 1 is a schematic view of the structure of an image forming apparatus according to this exemplary embodiment.

The image forming apparatus illustrated in FIG. 1 includes first to fourth electrophotographic image forming units 10Y, 10M, 10C, and 10K (image forming component) that produce images in the colors of yellow (Y), magenta (M), cyan (C), and black (K), respectively, based on color-separated image data. These image forming units (hereinafter also referred to simply as "units") 10Y, 10M, 10C, and 10K are arranged in a horizontal row with a predetermined distance therebetween. The units 10Y, 10M, 10C, and 10K may be process cartridges, i.e., units that can be attached to and detached from the image forming apparatus.

Above the units 10Y, 10M, 10C, and 10K, an intermediate transfer belt 20 (example of an intermediate transfer body) extends to pass through each of the units. The intermediate transfer belt 20 is wound over a drive roller 22 and a support roller 24 and runs in the direction from the first unit 10Y to the fourth unit 10K. The support roller 24 is forced by a spring or similar mechanism, not illustrated in the drawing, to go away from the drive roller 22, thereby placing tension on the intermediate transfer belt 20 wound over the two rollers. On the image-carrying side of the intermediate transfer belt 20 is a cleaning device 30 for the intermediate transfer belt 20 facing the drive roller 22.

The units 10Y, 10M, 10C, and 10K have developing devices (example of a developing component) 4Y, 4M, 4C, and 4K, to which yellow, magenta, cyan, and black toners, respectively, are delivered from toner cartridges 8Y, 8M, 8C, and 8K.

The first to fourth units 10Y, 10M, 10C, and 10K are equivalent in structure and operation. In the following, the first unit 10Y, located upstream of the others in the direction of running of the intermediate transfer belt 20 and forms a yellow image, is described to represent the four units.

The first unit 10Y has a photoreceptor 1Y that acts as an image carrier. Around the photoreceptor 1Y are a charging roller (example of a charging component) 2Y that charges the surface of the photoreceptor 1Y to a predetermined potential; an exposure device (example of an electrostatic charge image creating component) 3 that irradiates the charged surface with a laser beam 3Y produced on the basis of a color-separated image signal to create an electrostatic charge image there; a developing device (example of a developing component) 4Y that supplies charged toner to the electrostatic charge image to develop the electrostatic charge image; a first transfer roller (example of a first transfer component) 5Y that transfers the developed toner image to the intermediate transfer belt 20; and a photoreceptor cleaning device (example of a cleaning component) 6Y that removes residual toner off the surface of the photoreceptor 1Y after the first transfer, arranged in this order.

The first transfer roller 5Y is inside the intermediate transfer belt 20 and faces the photoreceptor 1Y. The first transfer roller 5Y, 5M, 5C, or 5K of each unit is connected to a bias power supply (not illustrated) that applies a first transfer bias to the roller. Each bias power supply is controlled by a controller, not illustrated in the drawing, to change the value of the transfer bias it applies to the corresponding first transfer roller.

The operation of forming a yellow image at the first unit 10Y may be as described below.

First, before the operation, the charging roller 2Y charges the surface of the photoreceptor 1Y to a potential of −600 V to −800 V.

The photoreceptor 1Y is a stack of an electrically conductive substrate (e.g., having a volume resistivity at 20° C. of $1\times10^{-6}$ Ωcm or less) and a photosensitive layer thereon. The photosensitive layer is of high electrical resistance (has the typical resistance of resin) in its normal state, but when it is irradiated with a laser beam, the resistivity of the irradiated portion changes. Thus, a laser beam 3Y is emitted from the exposure device 3 onto the charged surface of the photoreceptor 1Y in accordance with data for the yellow image sent from a controller, not illustrated in the drawing. This will create an electrostatic charge image as a pattern for the yellow image on the surface of the photoreceptor 1Y.

The electrostatic charge image is an image created on the surface of the photoreceptor 1Y by electrical charging and is a so-called negative latent image, created after the charge on the surface of the photoreceptor 1Y flows away in the irradiated portion of the photosensitive layer as a result of a resistivity decrease caused by the exposure to the laser beam 3Y but stays in the portion of the photosensitive layer not irradiated with the laser beam 3Y.

As the photoreceptor 1Y rotates, the electrostatic charge image created on the photoreceptor 1Y moves to a predetermined development point. At this development point, the electrostatic charge image on the photoreceptor 1Y is developed and visualized as a toner image by the developing device 4Y.

Inside the developing device 4Y is an electrostatic charge image developer that contains, for example, at least yellow toner and a carrier. The yellow toner is on a developer roller (example of a developer carrier) and has been triboelectrically charged with the same polarity as the charge on the photoreceptor 1Y (negative) as a result of being stirred inside the developing device 4Y. As the surface of the photoreceptor 1Y passes through the developing device 4Y, the yellow toner electrostatically adheres to the uncharged, latent-image portion of the surface of the photoreceptor 1Y and develops the latent image. The photoreceptor 1Y, now having a yellow toner image thereon, then continues rotating at a predetermined speed, transporting the toner image developed thereon to a predetermined first transfer point.

After the arrival of the yellow toner image on the photoreceptor 1Y at the first transfer point, a first transfer bias is applied to the first transfer roller 5Y. An electrostatic force acts on the toner image in the direction from the photoreceptor 1Y toward the first transfer roller 5Y, causing the toner image to be transferred from the photoreceptor 1Y to the intermediate transfer belt 20. The applied transfer bias has the (+) polarity, opposite the polarity of the toner (−), and its amount is controlled by a controller (not illustrated). For the first unit 10Y, it is controlled to, for example, +10 μA.

Residual toner on the photoreceptor 1Y is removed and collected at the photoreceptor cleaning device 6Y.

The first transfer biases applied to the first transfer rollers 5M, 5C, and 5K of the second, third, and fourth units 10M, 10C, and 10K are also controlled in the same way as that at the first unit 10Y.

The intermediate transfer belt 20 to which a yellow toner image has been transferred at the first unit 10Y in this way is then transported passing through the second to fourth units 10M, 10C, and 10K sequentially. Toner images in the respective colors are overlaid, completing multilayer transfer.

The intermediate transfer belt 20 that has passed through the first to fourth units and thereby completed multilayer transfer of toner images in four colors then reaches a second transfer section. The second transfer section is formed by the intermediate transfer belt 20, the support roller 24, which touches the inner surface of the intermediate transfer belt 20, and a second transfer roller (example of a second transfer component) 26, which is on the image-carrying side of the intermediate transfer belt 20. Recording paper (example of a recording medium) P is fed to the point of contact between the second transfer roller 26 and the intermediate transfer belt 20 in a timed manner by a feeding mechanism, and a second transfer bias is applied to the support roller 24. The applied transfer bias has the (−) polarity, the same as the polarity of the toner (−). An electrostatic force acts on the toner image in the direction from the intermediate transfer belt 20 toward the recording paper P, causing the toner image to be transferred from the intermediate transfer belt 20 to the recording paper P. The amount of the second transfer bias has been controlled and is determined in accordance with the resistance detected by a resistance detector (not illustrated) that detects the electrical resistance of the second transfer section.

After that, the recording paper P is sent to the point of pressure contact (nip) between a pair of fixing rollers at a fixing device (example of a fixing component) 28. The toner image is fixed on the recording paper P there, giving a fixed image.

The recording paper P to which the toner image is transferred can be, for example, a piece of ordinary printing paper for copiers, printers, etc., of electrophotographic type. In addition to recording paper P, recording media such as overhead-projector (OHP) sheets may also be used.

The use of recording paper P having a smooth surface may help further improve the smoothness of the surface of the fixed image. For example, coated paper, which is paper with a coating, for example of resin, on its surface, or art paper for printing may be used.

The recording paper P with a completely fixed color image thereon is transported to an ejection section to finish the formation of a color image.

Process Cartridge and Toner Cartridge

The following describes a process cartridge according to an exemplary embodiment.

A process cartridge according to this exemplary embodiment includes a developing component that contains an electrostatic charge image developer according to an above exemplary embodiment and develops, using the electrostatic charge image developer, an electrostatic charge image created on the surface of an image carrier to form a toner image. The process cartridge can be attached to and detached from an image forming apparatus.

This is not the only possible configuration of a process cartridge according to this exemplary embodiment. Besides the developing component, the process cartridge may optionally have at least one extra component selected from an image carrier, a charging component, an electrostatic charge image creating component, a transfer component, etc.

The following describes an example of a process cartridge according to this exemplary embodiment. This is not the only possible form. The following describes some of its structural elements with reference to a drawing.

Figure 2:
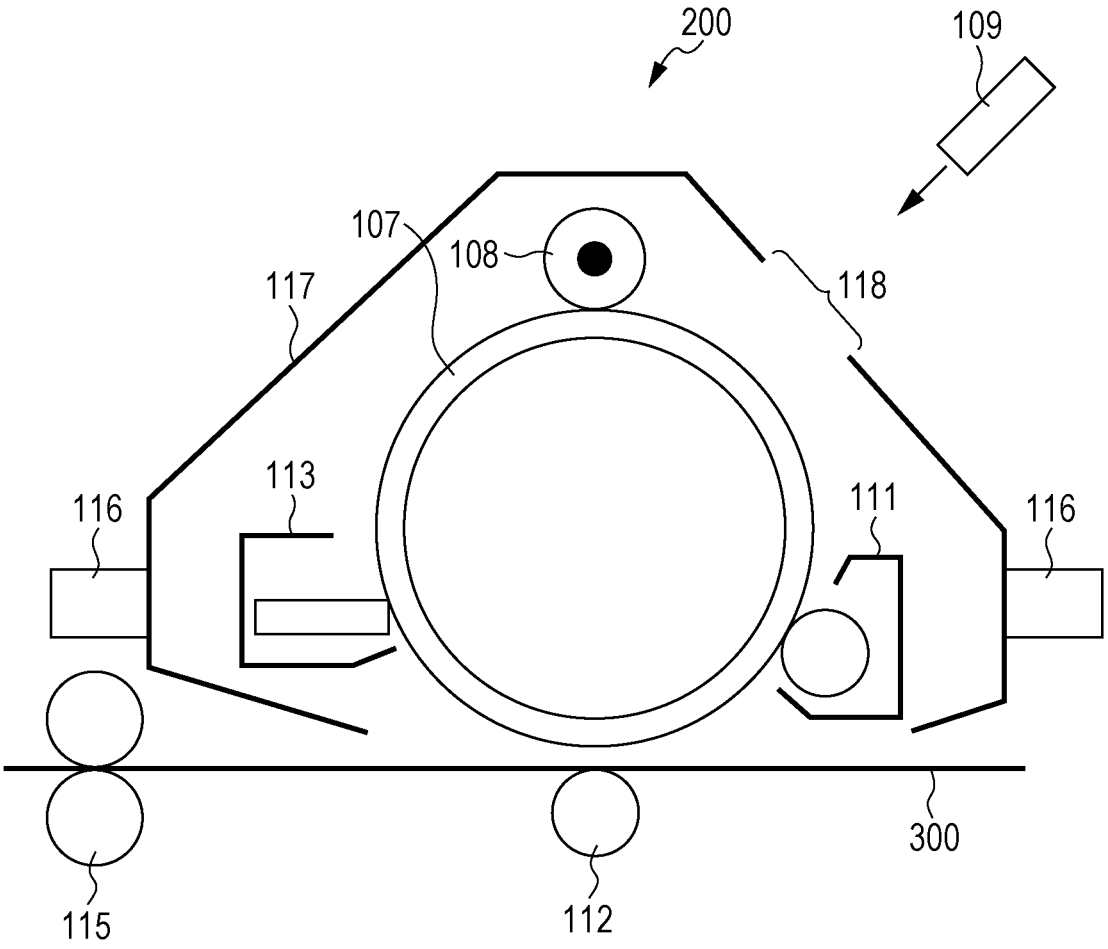
FIG. 2 is a schematic view of the structure of an example of a process cartridge according to an exemplary embodiment that is attached to and detached from an image forming apparatus.

FIG. 2 is a schematic view of the structure of a process cartridge according to this exemplary embodiment.

The process cartridge 200 illustrated in FIG. 2 is a cartridge formed by, for example, a housing 117 and components held together therein. The housing 117 has attachment rails 116 and an opening 118 for exposure to light. The components inside the housing 117 include a photoreceptor 107 (example of an image carrier) and a charging roller 108 (example of a charging component), a developing device 111 (example of a developing component), and a photoreceptor cleaning device 113 (example of a cleaning component) disposed around the photoreceptor 107.

FIG. 2 also illustrates an exposure device (example of an electrostatic charge image creating component) 109, a transfer device (example of a transfer component) 112, a fixing device (example of a fixing component) 115, and recording paper (example of a recording medium) 300.

The following describes a toner cartridge according to an exemplary embodiment.

A toner cartridge according to this exemplary embodiment contains a toner according to an above exemplary embodiment and can be attached to and detached from an image forming apparatus. A toner cartridge is a cartridge that stores replenishment toner for a developing component placed inside an image forming apparatus.

The image forming apparatus illustrated in FIG. 1 has toner cartridges 8Y, 8M, 8C, and 8K that can be attached to and detached from to it. The developing devices 4Y, 4M, 4C, and 4K are connected to their corresponding toner cartridges (or the toner cartridges for their respective colors) by toner feed tubing, not illustrated in the drawing. When there is little toner in a toner cartridge, this toner cartridge is replaced.

EXAMPLES

The following describes exemplary embodiments of the present disclosure in further detail by providing examples, but the exemplary embodiments of the present disclosure are not limited to these examples.

In the following description, "parts" and "%" are by mass unless stated otherwise.

The syntheses, treatments, production, etc., are carried out at room temperature (25° C.±3° C.) unless stated otherwise.

Production of Liquid Dispersions of Particles

Production of Liquid Dispersion of Amorphous Polyester Resin Particles (A1)

Terephthalic acid: 69 parts
Fumaric acid: 31 parts
Ethylene glycol: 40 parts
1,5-Pentanediol: 45 parts These materials are put into a reactor equipped with a stirrer, a nitrogen inlet tube, a temperature sensor, and a rectifying column. With a nitrogen stream into the reactor, the temperature is increased to 220° C. over 1 hour. One part of titanium tetraethoxide is added to a total of 100 parts of the above materials. The temperature is increased to 240° C. over 0.5 hours while water is removed by distillation as it is formed. After 1 hour of dehydration condensation at 240° C., the reaction product is cooled. The resulting resin is amorphous polyester resin (A). Its weight-average molecular weight is 96000, and its glass transition temperature is 59° C.

In a vessel equipped with a temperature controller and a nitrogen purge system, 55 parts of ethyl acetate and 25 parts of 2-butanol are mixed together. Then 100 parts of amorphous polyester resin (A) is dissolved in the resulting solvent mixture by adding the resin little by little. The resulting solution is stirred with a 10% aqueous solution of ammonia (in an amount equivalent to three times, by molar ratio, the acid value of the resin) for 30 minutes. After the reactor is purged with dry nitrogen, 400 parts of deionized water is added dropwise with stirring at a maintained temperature of 40° C. to cause the mixture to emulsify. Then returning the resulting emulsion to 25° C. and removing the solvents under reduced pressure will give a liquid dispersion of resin particles. The volume-average diameter of the dispersed resin particles is 160 nm. Deionized water is added to this liquid dispersion of resin particles to a solids content of 20%. The resulting liquid dispersion is liquid dispersion of amorphous polyester resin particles (A1).

Production of Liquid Dispersion of Amorphous Polyester Resin Particles (A2)

A liquid dispersion of amorphous polyester resin particles is produced using amorphous polyester resin (A) and in the same way as liquid dispersion of amorphous polyester resin particles (A1), but the amount of ethyl acetate is changed from 55 parts to 45 parts. The resulting liquid dispersion is liquid dispersion of amorphous polyester resin particles (A2). The volume-average diameter of the resin particles is 230 nm, and the solids content is 20%.

Production of Liquid Dispersion of Amorphous Polyester Resin Particles (B1)

Terephthalic acid: 69 parts
Trimellitic acid: 31 parts
Ethylene glycol: 40 parts
1,5-Pentanediol: 45 parts These materials are put into a reactor equipped with a stirrer, a nitrogen inlet tube, a temperature sensor, and a rectifying column. With a nitrogen stream into the reactor, the temperature is increased to 220° C. over 1 hour. One part of titanium tetraethoxide is added to a total of 100 parts of the above materials. The temperature is increased to 240° C. over 0.5 hours with water is removed by distillation as it is formed. After 1 hour of dehydration condensation at 240° C., the reaction product is cooled. The resulting resin is amorphous polyester resin (B). Its weight-average molecular weight is 127000, and its glass transition temperature is 59° C.

In a vessel equipped with a temperature controller and a nitrogen purge system, 70 parts of ethyl acetate and 25 parts of 2-butanol are mixed together. Then 100 parts of amorphous polyester resin (B) is dissolved in the resulting solvent mixture by adding the resin little by little. The resulting solution is stirred with a 10% aqueous solution of ammonia (in an amount equivalent to three times, by molar ratio, the acid value of the resin) for 30 minutes. After the reactor is purged with dry nitrogen, 400 parts of deionized water is added dropwise with stirring at a maintained temperature of 40° C. to cause the mixture to emulsify. Then returning the resulting emulsion to 25° C. and removing the solvents under reduced pressure will give a liquid dispersion of resin particles. The volume-average diameter of the dispersed resin particles is 80 nm. Deionized water is added to this liquid dispersion of resin particles to a solids content of 20%. The resulting liquid dispersion is liquid dispersion of amorphous polyester resin particles (B1).

Production of Liquid Dispersion of Amorphous Polyester Resin Particles (B2)

A liquid dispersion of amorphous polyester resin particles is produced using amorphous polyester resin (B) and in the same way as liquid dispersion of amorphous polyester resin particles (B1), but the amount of ethyl acetate is changed from 70 parts to 60 parts. The resulting liquid dispersion is liquid dispersion of amorphous polyester resin particles (B2). The volume-average diameter of the resin particles is 130 nm, and the solids content is 20%.

Production of Liquid Dispersion of Amorphous Polyester Resin Particles (B3)

A liquid dispersion of amorphous polyester resin particles is produced using amorphous polyester resin (B) and in the same way as liquid dispersion of amorphous polyester resin particles (B1), but the amount of ethyl acetate is changed from 70 parts to 58 parts. The resulting liquid dispersion is liquid dispersion of amorphous polyester resin particles (B3). The volume-average diameter of the resin particles is 150 nm, and the solids content is 20%.

Production of Liquid Dispersion of Amorphous Polyester Resin Particles (B4)

A liquid dispersion of amorphous polyester resin particles is produced using amorphous polyester resin (B) and in the same way as liquid dispersion of amorphous polyester resin particles (B1), but the amount of ethyl acetate is changed from 70 parts to 85 parts. The resulting liquid dispersion is liquid dispersion of amorphous polyester resin particles (B4). The volume-average diameter of the resin particles is 50 nm, and the solids content is 20%.

Production of a Liquid Dispersion of Crystalline Polyester Resin Particles (C)

1,10-Decanedicarboxylic acid: 260 parts
1,6-Hexanediol: 167 parts
Dibutyltin oxide (catalyst): 0.3 parts These materials are put into a reactor dried by heating. After the air in the reactor is replaced with nitrogen gas to create an inert atmosphere, the materials are stirred under reflux for 5 hours at 180° C. by mechanical stirring. Then the resulting mixture is heated to 230° C. gently and stirred for 2 hours under reduced pressure. The thickened mixture is air-cooled to terminate the reaction, giving a crystalline polyester resin. Its weight-average molecular weight is 12600, and its melting temperature is 73° C.

A mixture of 90 parts of the crystalline polyester resin, 1.8 parts of an anionic surfactant (TaycaPower, Tayca Corporation), and 210 parts of deionized water is heated to 120° C., dispersed using a homogenizer (IKA's ULTRA-TURRAX T50), and then dispersed for 1 hour using a pressure-pump Gaulin homogenizer to give a liquid dispersion of resin particles. The volume-average diameter of the dispersed resin particles is 160 nm. Adding deionized water to this liquid dispersion of resin particles to a solids content of 20% will give a liquid dispersion of crystalline polyester resin particles (C).

Production of a Liquid Dispersion of Styrene-Acrylic Resin Particles (S)

Styrene: 375 parts
n-butyl acrylate: 25 parts
Acrylic acid: 2 parts
Dodecanethiol: 24 parts
Carbon tetrabromide: 4 parts An aqueous solution of surfactants is prepared by dissolving 6 parts of a nonionic surfactant (Sanyo Chemical Industries, Ltd.'s Nonipol 400) and 10 parts of an anionic surfactant (TaycaPower, Tayca Corporation) in 550 parts of deionized water. The above polymerization materials are mixed together until dissolution, and the resulting mixture is dispersed and emulsified in the aqueous solution of surfactants. Then an aqueous solution of 4 parts of ammonium persulfate in 50 parts of deionized water is put into the reactor with stirring over 20 minutes. After nitrogen purging, the reactor is heated in an oil bath with stirring until the temperature of the contents reaches 70° C. Emulsion polymerization is continued by holding the temperature at 70° C. for 5 hours, giving a liquid dispersion of resin particles. The volume-average diameter of the dispersed resin particles is 160 nm. Adding deionized water to this liquid dispersion of resin particles to a solids content of 20% will give a liquid dispersion of styrene-acrylic resin particles (S).

Production of Liquid Dispersion of Release-Agent Particles (W1)

A paraffin wax (Nippon Seiro Co., Ltd., FNP92; melting temperature, 92° C.): 100 parts
An anionic surfactant (TaycaPower, Tayca Corporation): 1 part
Deionized water: 350 parts These materials are mixed together, and the resulting mixture is heated to 100° C. The mixture is dispersed using a homogenizer (IKA's ULTRA-TURRAX T50) and then using a pressure-pump Gaulin homogenizer, giving a liquid dispersion of release-agent particles. The volume-average diameter of the dispersed particles of a release agent is 220 nm. Deionized water is added to this liquid dispersion of release-agent particles to a solids content of 20%. The resulting liquid dispersion is liquid dispersion of release-agent particles (W1).

Production of Liquid Dispersions of Release-Agent Particles (W2) to (W5)

Liquid dispersions of release-agent particles are produced in the same way as liquid dispersion of release-agent particles (W1), but with a greater or smaller amount of anionic surfactant (TaycaPower). The resulting liquid dispersions are liquid dispersions of release-agent particles (W2) to (W5). For all of them, the volume-average diameter of the particles of a release agent is 220 nm, and the solids content is 20%.

The surfactant content of each liquid dispersion of release-agent particles as a percentage to the mass of the particles of a release agent is as follows.

Liquid dispersion of release-agent particles (W1): 1% by mass
Liquid dispersion of release-agent particles (W2): 0.8% by mass
Liquid dispersion of release-agent particles (W3): 2% by mass
Liquid dispersion of release-agent particles (W4): 5% by mass
Liquid dispersion of release-agent particles (W5): 6% by mass Production of Liquid Dispersion of Coloring-Agent Particles (K)

Carbon black (Cabot, Regal 330): 50 parts
An anionic surfactant (DKS Co., Ltd., Neogen RK): 5 parts
Deionized water: 193 parts These materials are mixed together, and the resulting mixture is dispersed for 10 minutes at 240 MPa using an Ultimaizer (Sugino Machine). The resulting liquid dispersion, having a solids concentration of 20%, is liquid dispersion of coloring-agent particles (K).

Production of Liquid Dispersion of Coloring-Agent Particles (C)

C.I. Pigment Blue 15:3 (Dainichiseika Color & Chemicals Mfg., Cyanine Blue 4937): 50 parts
An anionic surfactant (TaycaPower, Tayca Corporation): 5 parts
Deionized water: 193 parts These materials are mixed together, and the resulting mixture is dispersed for 10 minutes at 240 MPa using an Ultimaizer (Sugino Machine). The resulting liquid dispersion, having a solids concentration of 20%, is liquid dispersion of coloring-agent particles (C).

Production of Liquid Dispersion of Coloring-Agent Particles (M)

C.I. Pigment Red 269 (Dainippon Ink and Chemicals, SYMULER Fast Red 1022): 50 parts
An anionic surfactant (TaycaPower, Tayca Corporation): 5 parts
Deionized water: 193 parts These materials are mixed together, and the resulting mixture is dispersed for 10 minutes at 240 MPa using an Ultimaizer (Sugino Machine). The resulting liquid dispersion, having a solids concentration of 20%, is liquid dispersion of coloring-agent particles (M).

Production of Liquid Dispersion of Coloring-Agent Particles (Y)

C.I. Pigment Yellow 74 (Dainichiseika Color & Chemicals Mfg., Seika Fast Yellow 2054: 50 parts An anionic surfactant (TaycaPower, Tayca Corporation): 5 parts Deionized water: 193 parts These materials are mixed together, and the resulting mixture is dispersed for 10 minutes at 240 MPa using an Ultimaizer (Sugino Machine). The resulting liquid dispersion, having a solids concentration of 20%, is liquid dispersion of coloring-agent particles (Y).

Example 1

Aggregation

Deionized water: 500 parts

Liquid dispersion of amorphous polyester resin particles (A1): 263 parts

Liquid dispersion of amorphous polyester resin particles (B1): 263 parts

The liquid dispersion of crystalline polyester resin particles (C): 150 parts

The liquid dispersion of styrene-acrylic resin particles (S): 75 parts

Liquid dispersion of release-agent particles (W1): 150 parts

Liquid dispersion of coloring-agent particles (K): 150 parts

These materials are put into a reactor, and the pH is adjusted to 3.5 with 0.1 N nitric acid.

An aqueous solution of aluminum sulfate prepared by dissolving 1.5 parts of aluminum sulfate in 100 parts of deionized water is put to the reactor.

After dispersion using a homogenizer (IKA's ULTRA-TURRAX T50) at a liquid temperature of 30° C., the mixture is heated to a liquid temperature of 45° C. in a heating oil bath and maintained at this temperature until the volume-average diameter of the aggregates is 4.0 μm.

Second Aggregation

A mixture of 225 parts of liquid dispersion of amorphous polyester resin particles (A1) and 225 parts of liquid dispersion of amorphous polyester resin particles (B1) is put into the liquid dispersion containing aggregates. Allowing the resulting mixture to stand for 30 minutes will give second aggregates. Then the pH is adjusted to 9.0 with a 1 N aqueous solution of sodium hydroxide.

Coalescence

The reactor is heated to 85° C. at a rate of 0.3° C./min, maintained at 85° C. for 3 hours, and then cooled to 30° C. at 15° C./rain (first cooling) while the stirring of the contents is continued. Then the reactor is heated to 55° C. at a rate of 0.2° C./min (reheating), maintained at this temperature for 30 minutes, and then cooled to 30° C. at 0.5° C./min (second cooling). Then the solids are isolated by filtration, washed with deionized water, and dried. The resulting toner particles, having a volume-average diameter of 5.0 μm, are toner particles (K1).

Addition of an External Additive

One hundred parts of toner particles (K1) and 1.5 parts of hydrophobic silica (Nippon Aerosil Co., Ltd.'s RY50) are mixed together and blended for 30 seconds at a rotational speed of 10000 rpm using a sample mill. The resulting mixture is sieved through a 45-μm mesh vibrating sieve. The resulting toner is toner (K1). The volume-average diameter of particles of toner (K1) is 5.0 μm.

Production of a Carrier

Five hundred parts of spherical particles of magnetite (volume-average diameter, 0.55 μm) are stirred in a Henschel mixer and then stirred with 5 parts of a titanate coupling agent for 30 minutes at an increased temperature of 100° C. Then 500 parts of the magnetite particles treated with a titanate coupling agent is stirred in a four-neck flask with 6.25 parts of phenol, 9.25 parts of 35% formalin, 6.25 parts of 25% ammonia solution, and 425 parts of water and allowed to react for 120 minutes at 85° C. while stirring is continued. The reaction mixture is cooled to 25° C., and the precipitate is washed with water by adding 500 parts of water and removing the supernatant. The washed precipitate is dried by heating at reduced pressure. The resulting product is a carrier (CA). Its average diameter of particles is 35 μm.

Production of Developers

Toner (K1) and the carrier (CA) are put into a V-blender in a ratio of 5:95 (toner (K1):carrier (CA); by mass) and stirred for 20 minutes. The resulting mixture is developer (K1).

Toner particles, toners, and developers in the colors of cyan, magenta, and yellow are produced in the same way as toner particles (K1), toner (K1), and developer (K1). Liquid dispersion of coloring-agent particles (K) is changed to liquid dispersion of coloring-agent particles (C), (M), or (Y).

Examples 2 to 7 and Comparative Examples 1 and 2

Toner particles are obtained in the same way as in Example 1. At least one of liquid dispersion of amorphous polyester resin particles (A1), liquid dispersion of amorphous polyester resin particles (B1), or liquid dispersion of release-agent particles (W1) is changed as in Table 1. Then a developer is obtained by adding an external additive to the toner particles and mixing the particles with a carrier in the same way as in Example 1.

TABLE 1

| | Liquid dispersions of amorphous polyester resin particles | | Liquid dispersion of release-agent particles | Toner particles, toner, and developer | | | |
|---|---|---|---|---|---|---|---|
| | Liquid dispersion A | Liquid dispersion B | | Black | Cyan | Magenta | Yellow |
| Example 1 | A1 | B1 | W1 | K1 | C1 | M1 | Y1 |
| Example 2 | A1 | B2 | W1 | K2 | C2 | M2 | Y2 |
| Example 3 | A2 | B1 | W1 | K3 | C3 | M3 | Y3 |
| Example 4 | A1 | B1 | W2 | K4 | C4 | M4 | Y4 |
| Example 5 | A1 | B1 | W3 | K5 | C5 | M5 | Y5 |
| Example 6 | A1 | B1 | W4 | K6 | C6 | M6 | Y6 |
| Example 7 | A1 | B1 | W5 | K7 | C7 | M7 | Y7 |
| Comparative Example 1 | A1 | B3 | W1 | K8 | C8 | M8 | Y8 |
| Comparative Example 2 | A2 | B4 | W1 | K9 | C9 | M9 | Y9 |

Testing for Color-Gamut Reproduction

The developers are loaded into the developing devices of a modified version of ApeosPort-IV C5575 image forming apparatus (Fuji Xerox). Using this image forming apparatus, 5 cm×5 cm secondary- or primary-color images are formed on a piece of paper (J Paper, Fuji Xerox Co., Ltd.; smoothness measured as per JIS P8119: 1998, 86 seconds) under 32° C. and 90% RH conditions. The amount of toner required for a density of 100% is adjusted to 4.2 g/m$^2$ for each color. The colors of the secondary- or primary-color images are as follows.

An image in the secondary color C/M, formed by 100% cyan toner and 100% magenta toner An image in the secondary color C/Y, formed by 100% cyan toner and 100% yellow toner An image in the secondary color M/Y, formed by 100% magenta toner and 100% yellow toner An image in the primary color K, formed by 100% black toner The lightness (L*) of each image and the chroma ($C^*=(a^{*2}+b^{*2})^{0.5}$) of the secondary-color images are measured.

Using X-Rite 939 (aperture, 4 mm), ten measurements are taken randomly in the image and averaged. The measured lightness (L*) and chroma (C*) are graded as follows. The results are presented in Table 2.

For L*, smaller values indicate higher lightness. G5, G4, and G3 are acceptable.

For C*, greater values indicate higher chroma. G5, G4, and G3 are acceptable.

Lightness (L*) of the C/M Image

G5: L* is less than 19

G4: L* is 19 or more and less than 20

G3: L* is 20 or more and less than 21

G2: L* is 21 or more and less than 22

G1: L* is 22 or more

Chroma (*C) of the C/M Image

G5: C* is 54 or more

G4: C* is 52 or more and less than 54

G3: C* is 50 or more and less than 52

G2: C* is 48 or more and less than 50

G1: C* is less than 48

Lightness (*L) of the C/Y Image

G5: L* is 49 less than

G4: L* is 49 or more and less than 50

G3: L* is 50 or more and less than 51

G2: L* is 51 or more and less than 52

G1: L* is 52 or more

Chroma (*C) of the C/Y Image

G5: C* is 75 or more

G4: C* is 73 or more and less than 75

G3: C* is 71 or more and less than 73

G2: C* is 69 or more and less than 71

G1: C* is less than 69

Lightness (*L) of the M/Y Image

G5: L* is less than 48

G4: L* is 48 or more and less than 49

G3: L* is 49 or more and less than 50

G2: L* is 50 or more and less than 51

G1: L* is 51 or more

Chroma (*C) of the M/Y Image

G5: C* is 89 or more

G4: C* is 87 or more and less than 89

G3: C* is 85 or more and less than 87

G2: C* is 83 or more and less than 85

G1: C* is less than 83

Lightness (*L) of the K Image

G5: L* is less than 7

G4: L* is 7 or more and less than 10

G3: L* is 10 or more and less than 13

G2: L* is 13 or more and less than 16

G1: L* is 16 or more

TABLE 2

| | Liquid dispersions of amorphous polyester resin particles | | | Liquid | | | | | | | | | | | | |
|---|---|---|---|---|---|---|---|---|---|---|---|---|---|---|---|---|
| | Liquid dispersion A Volume-average diameter of particles | Liquid dispersion B Volume-average diameter of particles | D1- | dispersion of release-agent particles Percentage of surfactant to the release agent | Domains of the release agent Requirement | Domains of the coloring agent Requirement (2) Mean | Domains of the coloring agent Requirement (2) Standard deviation | Domains of the coloring agent Requirement (3) % by number | Lightness of secondary-color images | | | Chroma of secondary-color images | | | Lightness of the primary-color images |
| | D1 nm | D2 nm | D2 nm | % by mass | (1) n | μm$^2$ | μm$^2$ | | C/M — | C/Y — | M/Y — | C/M — | C/Y — | M/Y — | K — |
| Comparative Example 1 | 160 | 150 | 10 | 1 | 14 | 0.090 | 0.016 | 4 | G1 | G1 | G1 | G1 | G1 | G1 | G1 |
| Comparative Example 2 | 230 | 50 | 180 | 1 | 16 | 0.080 | 0.012 | 3 | G2 | G2 | G2 | G2 | G2 | G2 | G2 |
| Example 1 | 160 | 80 | 80 | 1 | 17 | 0.030 | 0.001 | 0 | G5 | G5 | G5 | G5 | G5 | G5 | G5 |
| Example 2 | 160 | 130 | 30 | 1 | 13 | 0.050 | 0.008 | 1 | G4 | G4 | G4 | G4 | G4 | G4 | G3 |
| Example 3 | 230 | 80 | 150 | 1 | 15 | 0.020 | 0.005 | 1 | G4 | G4 | G4 | G4 | G4 | G4 | G4 |
| Example 4 | 160 | 80 | 80 | 0.8 | 11 | 0.050 | 0.006 | 2 | G4 | G4 | G4 | G4 | G4 | G4 | G5 |
| Example 5 | 160 | 80 | 80 | 2 | 18 | 0.040 | 0.003 | 2 | G5 | G5 | G5 | G5 | G5 | G5 | G4 |
| Example 6 | 160 | 80 | 80 | 5 | 20 | 0.050 | 0.007 | 3 | G4 | G4 | G4 | G4 | G4 | G4 | G3 |
| Example 7 | 160 | 80 | 80 | 6 | 23 | 0.060 | 0.009 | 4 | G3 | G3 | G3 | G3 | G3 | G3 | G3 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for developing an electrostatic charge image, the toner comprising toner particles containing at least one binder resin, a release agent, and a coloring agent, a cross-sectional image of the toner particles meeting requirements (1) and (2):

requirement (1), an average of ten or more domains, per toner particle, of the release agent have an area of 0.5% or more and 5.0% or less of an area of the toner particle;

requirement (2), in a Voronoi tessellation generated from centroids of domains of the coloring agent, a mean area of Voronoi cells is 0.020 $\mu m^2$ or more and 0.060 $\mu m^2$ or less, and a standard deviation of areas of the Voronoi cells is 0.010 $\mu m^2$ or less.

2. The toner according to claim 1 for developing an electrostatic charge image, wherein the cross-sectional image of the toner particles further meets requirement (3):

requirement (3), of all domains of the coloring agent present in the toner particles, 0% by number or more and less than 5% by number are present in a region from a surface to a depth of 100 nm of the toner particle.

3. The toner according to claim 2 for developing an electrostatic charge image, wherein the binder resin includes an amorphous polyester resin and a crystalline polyester resin.

4. The toner according to claim 1 for developing an electrostatic charge image, wherein the binder resin includes an amorphous polyester resin and a crystalline polyester resin.

5. An electrostatic charge image developer comprising the toner according to claim 1 for developing an electrostatic charge image.

6. A process cartridge that is attached to and detached from an image forming apparatus, the process cartridge comprising:

a developing component that contains the electrostatic charge image developer according to claim 5 and develops, using the electrostatic charge image developer, an electrostatic charge image on a surface of an image carrier to form a toner image.

7. An image forming apparatus comprising:

an image carrier;

a charging component that charges a surface of the image carrier;

an electrostatic charge image creating component that creates an electrostatic charge image on the charged surface of the image carrier;

a developing component that contains the electrostatic charge image developer according to claim 5 and develops, using the electrostatic charge image developer, the electrostatic charge image on the surface of the image carrier to form a toner image;

a transfer component that transfers the toner image on the surface of the image carrier to a surface of a recording medium; and a fixing component that fixes the toner image on the surface of the recording medium.

8. An image forming method comprising:

charging a surface of an image carrier;

creating an electrostatic charge image on the charged surface of the image carrier;

developing, using the electrostatic charge image developer according to claim 5, the electrostatic charge image on the surface of the image carrier to form a toner image;

transferring the toner image on the surface of the image carrier to a surface of a recording medium; and fixing the toner image on the surface of the recording medium.

9. A toner cartridge that is attached to and detached from an image forming apparatus, the toner cartridge comprising the toner according to claim 1 for developing an electrostatic charge image.

10. A method for producing a toner for developing an electrostatic charge image, the method comprising:

mixing a plurality of liquid dispersions of binder-resin particles, each of which contains particles of a binder resin, a liquid dispersion of release-agent particles, which contains particles of a release agent, and a liquid dispersion of coloring-agent particles, which contains particles of a coloring agent, together to give a liquid dispersion mixture containing the particles of binder resins, the particles of a release agent, and the particles of coloring agent;

forming aggregates by causing the particles of binder resins, the particles of a release agent, and the particles of a coloring agent to aggregate in the liquid dispersion mixture; and forming toner particles by heating a liquid dispersion containing the aggregates and thereby making the aggregates fuse and coalesce, wherein:

the liquid dispersions of binder-resin particles include at least two liquid dispersions of amorphous polyester resin particles, each of which contains particles of an amorphous polyester resin; and a difference between D1 and D2 is 30 nm or more and 150 nm or less, where D1 is a volume-average diameter of the particles of an amorphous polyester resin in the liquid dispersion in which the particles of an amorphous polyester resin have a greater diameter than the other of, or a greatest diameter among all of, the at least two, and D2 is a volume-average diameter of the particles of an amorphous polyester resin in the liquid dispersion in which the particles of an amorphous polyester resin have a smaller diameter than the other of, or a smallest diameter among all of, the at least two.

11. The method according to claim 10 for producing a toner for developing an electrostatic charge image, wherein the volume-average diameter of particles D1 is 130 nm or more and 250 nm or less.

12. The method according to claim 11 for producing a toner for developing an electrostatic charge image, wherein the volume-average diameter of particles D2 is 50 nm or more and 100 nm or less.

13. The method according to claim 12 for producing a toner for developing an electrostatic charge image, wherein the liquid dispersions of binder-resin particles further include a liquid dispersion of crystalline polyester resin particles, which contains particles of a crystalline polyester resin.

14. The method according to claim 11 for producing a toner for developing an electrostatic charge image, wherein the liquid dispersions of binder-resin particles further include a liquid dispersion of crystalline polyester resin particles, which contains particles of a crystalline polyester resin.

15. The method according to claim 10 for producing a toner for developing an electrostatic charge image, wherein the volume-average diameter of particles D2 is 50 nm or more and 100 nm or less.

16. The method according to claim 15 for producing a toner for developing an electrostatic charge image, wherein the liquid dispersions of binder-resin particles further include a liquid dispersion of crystalline polyester resin particles, which contains particles of a crystalline polyester resin.

17. The method according to claim 10 for producing a toner for developing an electrostatic charge image, wherein the liquid dispersions of binder-resin particles further include a liquid dispersion of crystalline polyester resin particles, which contains particles of a crystalline polyester resin.

18. The method according to claim 10 for producing a toner for developing an electrostatic charge image, wherein a surfactant content of the liquid dispersion of release-agent particles is 1% by mass or more and 5% by mass or less of a mass of the particles of a release agent.

19. A toner for developing an electrostatic charge image produced by the method according to claim 10 for producing a toner for developing an electrostatic charge image.

20. An electrostatic charge image developer comprising a toner for developing an electrostatic charge image produced by the method according to claim 10 for a toner for developing an electrostatic charge image.

* * * * *